US005903978A

United States Patent [19]

Prochaska et al.

[11] Patent Number: 5,903,978

[45] Date of Patent: May 18, 1999

[54] RAZOR HANDLE AND CADDY

[75] Inventors: Frank H. Prochaska, Waynesboro; Jeffrey W. Wonderley, Defiance, both of Va.

[73] Assignee: American Safety Razor Company, Verona, Va.

[21] Appl. No.: 08/911,917

[22] Filed: Aug. 15, 1997

Related U.S. Application Data

[ 60] Provisional application No. 60/024,281, Aug. 16, 1996.

[51] Int. Cl.[6] ..... B26B 21/40

[52] U.S. Cl. ..... 30/34.05; 30/541; D9/342

[58] Field of Search ..... 30/34.05, 526, 30/537, 541; D6/526; D9/342; D28/45, 46, 47, 48; 211/70.6; 248/127

[56] References Cited

U.S. PATENT DOCUMENTS

| | | | |
|---|---|---|---|
| D. 279,613 | 7/1985 | Hannemann | D28/48 |
| D. 354,586 | 1/1995 | Grange | D28/46 |
| D. 355,049 | 1/1995 | Yasui | D28/48 |
| D. 370,844 | 6/1996 | Shurtleff et al. | D9/342 |
| D. 373,444 | 9/1996 | Shurtleff et al. | D28/48 |
| 5,031,319 | 7/1991 | Althaus et al. | 30/526 |
| 5,228,580 | 7/1993 | Grange | 211/70.6 |
| 5,457,887 | 10/1995 | Grange | 30/541 |
| 5,497,551 | 3/1996 | Apprille, Jr. | 30/526 |

*Primary Examiner*—Hwei-Siu Payer
*Attorney, Agent, or Firm*—McDermott, Will & Emery

[57] ABSTRACT

A razor caddy receives a razor handle suitable for supporting a razor cartridge. The top and bottom handle surfaces have a continuous index finger profile when gripped on the top surface of the razor handle. The razor handle has a widened portion proximate to a proximate end, and side portions of the razor handle form a concave profile between the proximate end and the distal end. The side portions also form a widened portion at the distal end. The index finger profile of the razor handle defines a detail and a normal shaving position structure in combination with the handle top and bottom surface. First and second elastomeric gripping portions are each positioned on the bottom of the handle. The detail shaving position is achieved by the first gripping portion having a defined thumb engaging area proximate to the proximate end, with the elastomeric material defining correct thumb placement. The second gripping area is positioned near the distal end of the handle. An apex shaped top surface of the razor handle is disposed to fit into the "life line" crease of a user's hand to provide secure gripping and control. The razor caddy has at least two spaced apart depressions suitable to receive the proximate and distal ends of the razor handle. The caddy, together with the razor handle, defines a substantially elliptical opening suitable to receive a user's digits upon the bottom surface of the razor handle.

10 Claims, 8 Drawing Sheets

RAZOR HANDLE AND CADDY

BACKGROUND OF THE INVENTION

This application is based on Provisional Application No. 60/024,281, having a filing dated of Aug. 16, 1996.

The present invention relates to wet shaving razor handles and a razor caddy, and more particularly to a safety razor handle designed to receive a razor cartridge on which a blade assembly is mounted. The handle shape is conformed to the user's hand so that the razor handle can define multiple control positions. A razor caddy in combination with the razor handle is provided which allows multiple user digits to grasp the razor handle when removing the razor handle from the caddy.

In the prior art, various shapes and configurations of wet shaver razor handles have been provided for user comfort. Also, for user comfort and control, a razor caddy has been provided to store a razor handle for packaging and distribution of the razor handle, as well for user convenience. U.S. Pat. No. 5,457,887 issued to Kenneth Grange on Oct. 17, 1995 entitled "HOLDER FOR WET SHAVER" illustrates a holder for a wet shaver having a planar body and an upper side with a substantially half shell contour. The upper side defines a depression for receiving a wet razor handle, with the depression having a depth and contour suitable to complement the half shell contour.

U.S. Design Pat. No. 370,844 issued to J. Shurtleff et al. on Jun. 18, 1996 entitled RAZOR HOLDER also shows a razor holder suitable to receive a wet razor handle and a tray containing razor cartridge.

U.S. Pat. No. 5,497,551 issued to D. V. Apprille, Jr. on Mar. 12, 1996 entitled RAZOR HANDLE ASSEMBLY, illustrates a safety razor handle having a elastomeric grip portion positioned between a pair of shells forming a substantially planar body member.

U.S. Pat. No. 5,031,319 issued to W. Althaus and K. Grange on Jul. 16, 1991 entitled WET RAZOR illustrates an "S" shaped razor handle with a rear tongue like widened portion. A padding means such as rubber or plastic form contact surfaces for the finger digits.

None of the patents described above provides the important advantages of providing an arcuate wet shaver razor handle shaped to complement a users finger profile, and having a plurality of elastomeric inserts on the underside of the handle to define normal and detail shaving positions. In addition, the above patents do not describe a razor caddy having a plurality of shaped depressions, which in combination with the razor handle, defines an opening to more fully receive a users digits in manner suitable to engage the bottom of the razor handle to enable lifting of the razor handle from the caddy.

SUMMARY OF THE INVENTION

The invention itself, together with further objects and attendant advantages, will best be understood by reference to the following detailed description taken in conjunction with the accompanying drawings.

DETAILED DESCRIPTION OF THE INVENTION

Figure 1:
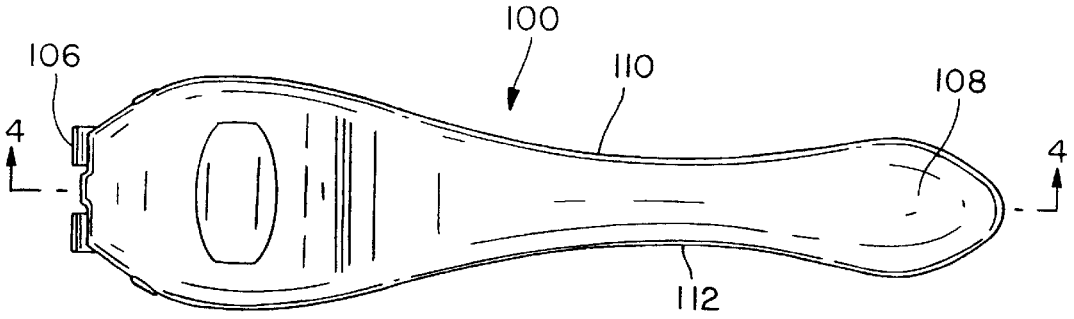
FIG. 1 is a top plan view of the razor handle.

Turning now to FIGS. 14–18 of the drawings, a combination 10 of a razor handle 100 and razor caddy 200 for supporting a razor cartridge 300 at one end of the razor handle is illustrated.

As illustrated in FIGS. 1–7, the razor handle 100 comprises an elongated member defining generally concentric convex top and bottom surfaces 102,104, respectively, each having a continuous arcuate "index finger profile" along points "P—P" when gripped with a users digits (not shown) on the top surface 102 of the razor handle 100 and a thumb on the bottom surface 104. In more detail, the "index finger profile" is a profile of a user's hand in a rest position which follows a line along the inner surface of the index finger and continuing along the line formed by the "life line" crease formed between the thumb and index finger and directed towards the wrist.

One end of the razor handle 100 has a widened "tongue-like" portion proximate to a cartridge receiving end 106 (or proximate end). Side portions 110,112 of the razor handle 100 form a concave profile between the proximate end 106 and a distal end 108 of the razor handle 100. The side portions 110,112 also form a widened "tongue-like" portion at the distal end 108 of the razor handle 100.

The "index finger profile" along points "P—P" of the razor handle 100 defines a detail and a normal shaving position in combination with the top surface 102 and the bottom surface 104 of the razor handle 100. First and second elastomeric gripping portions 120,122, respectively, such as rubber, plastic or the like, are each positioned on the bottom surface 104 of the razor handle 100. For example, a suitable elastomeric material would have a durometer of between about 40 to about 60 on the Shore A 40 to Shore A 60 scale.

The detailed shaving position (and structure) is defined by the first gripping portion 120 having a defined thumb engaging area of elastomeric material proximate to the proximate handle portion 106. The shape of the elastomeric material, such as a tear-drop shape or the like, defines the correct placement position of the thumb for use in the first detail shaving position. The flattened widened portion of the razor handle proximate end 106 provides a wide bearing area suitable for engagement of a users digits.

Figure 2:
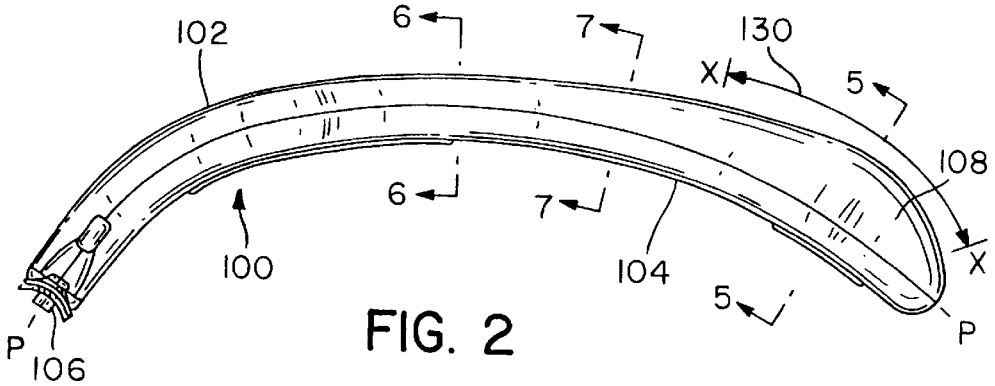
FIG. 2 is a side view of the razor handle, with the opposing side view being a mirror image of FIG. 2.
Figure 3:
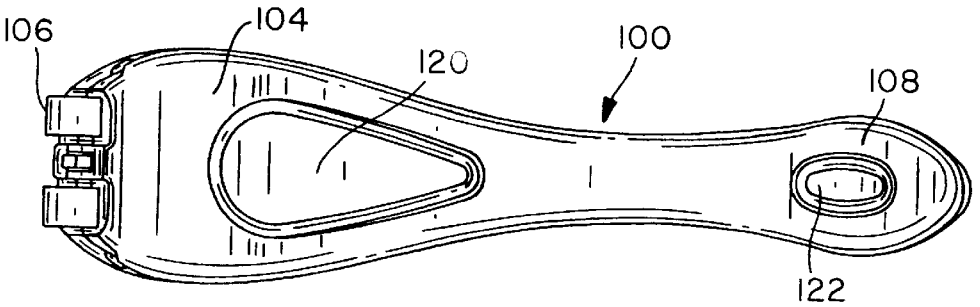
FIG. 3 is bottom view of the razor handle.
Figure 4:
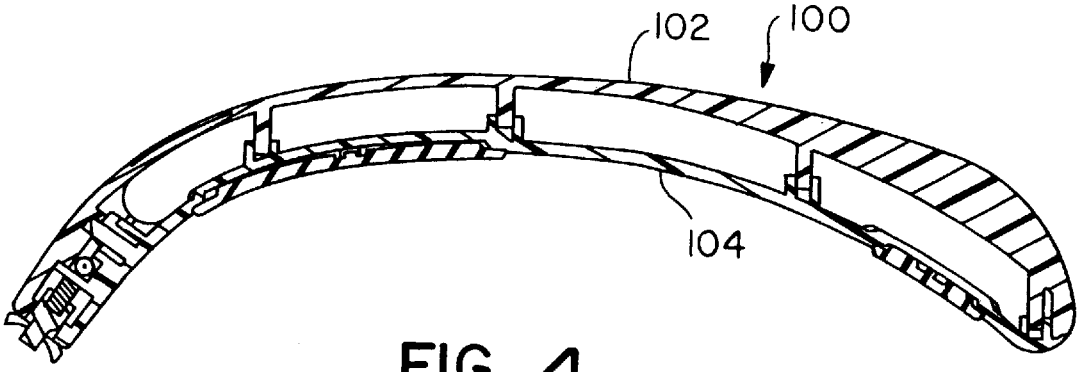
FIG. 4 is a cross-sectional profile of the razor handle of FIG. 1 taken along line 4—4 of FIG. 1.
Figure 5:
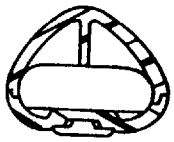
FIG. 5 is a cross-sectional profile of the razor handle taken along line 5—5 of FIG. 2.
Figure 6:
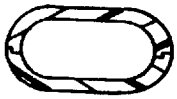
FIG. 6 is a cross-sectional profile of the razor handle taken along line 6—6 of FIG. 2.
Figure 7:
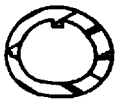
FIG. 7 is a cross-sectional profile of the razor handle taken along line 7—7 of FIG. 2.
Figure 8:
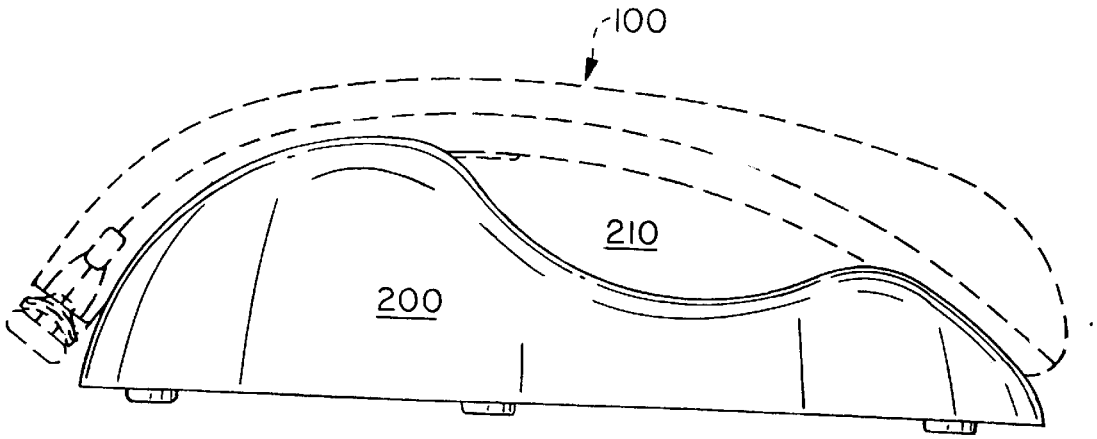
FIG. 8 is a side view of the RAZOR CADDY with the assembled RAZOR HANDLE and CARTRIDGE together illustrated in broken lines.
Figure 9:
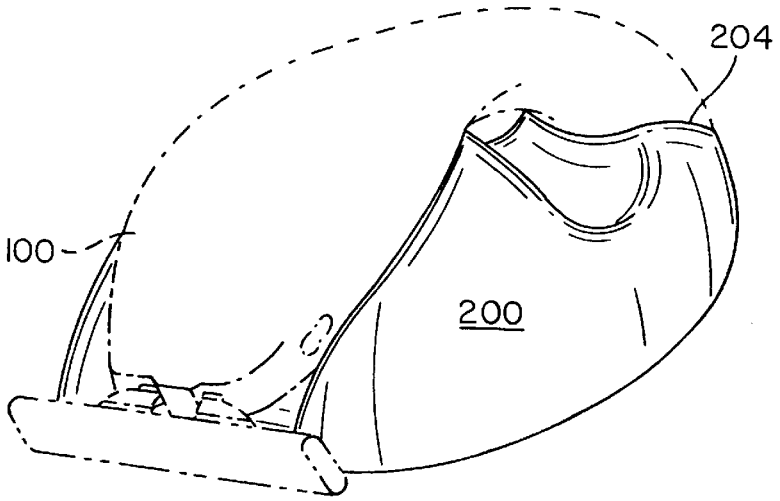
FIG. 9 is a top right front perspective view of the RAZOR CADDY of FIG. 8 with the assembled RAZOR HANDLE and CARTRIDGE together illustrated in broken lines.
Figure 10:
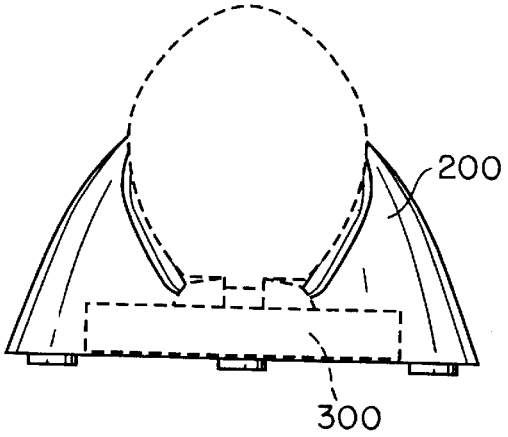
FIG. 10 is a front view of the RAZOR CADDY of FIG. 8 with the assembled RAZOR HANDLE and CARTRIDGE illustrated in broken lines.
Figure 11:
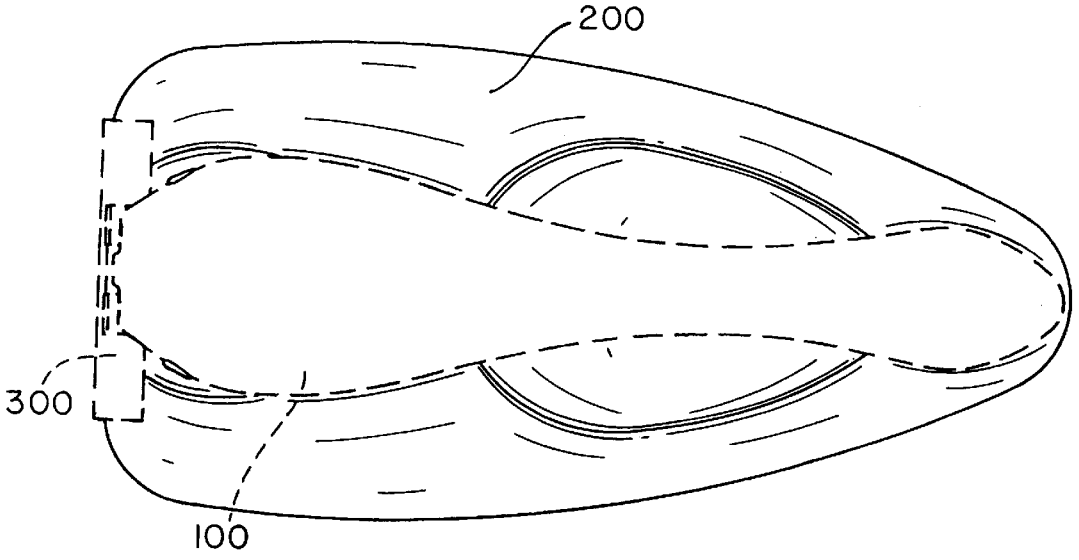
FIG. 11 is a top view of the RAZOR CADDY of FIG. 8 with the assembled RAZOR HANDLE and CARTRIDGE together and disassembled from the RAZOR CADDY of FIG. 8, with the assembled RAZOR HANDLE AND CARTRIDGE illustrated in broken lines.
Figure 12:
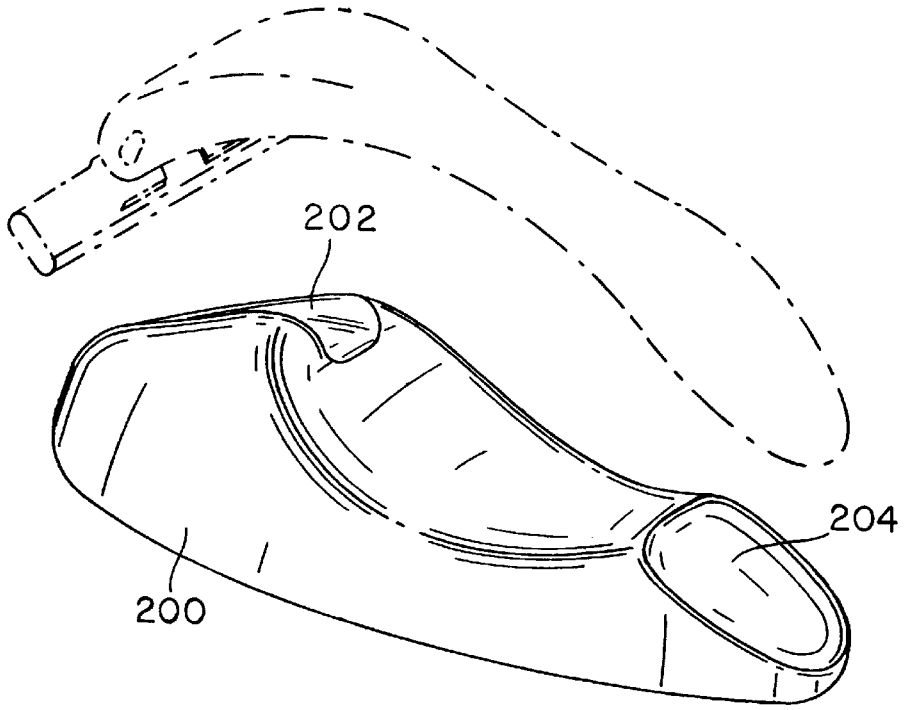
FIG. 12 is a top right rear perspective view of the RAZOR CADDY of FIG. 8 with the assembled RAZOR HANDLE and CARTRIDGE together and disassembled from the RAZOR CADDY, the assembled RAZOR HANDLE and CARTRIDGE illustrated in broken lines.
Figure 13:
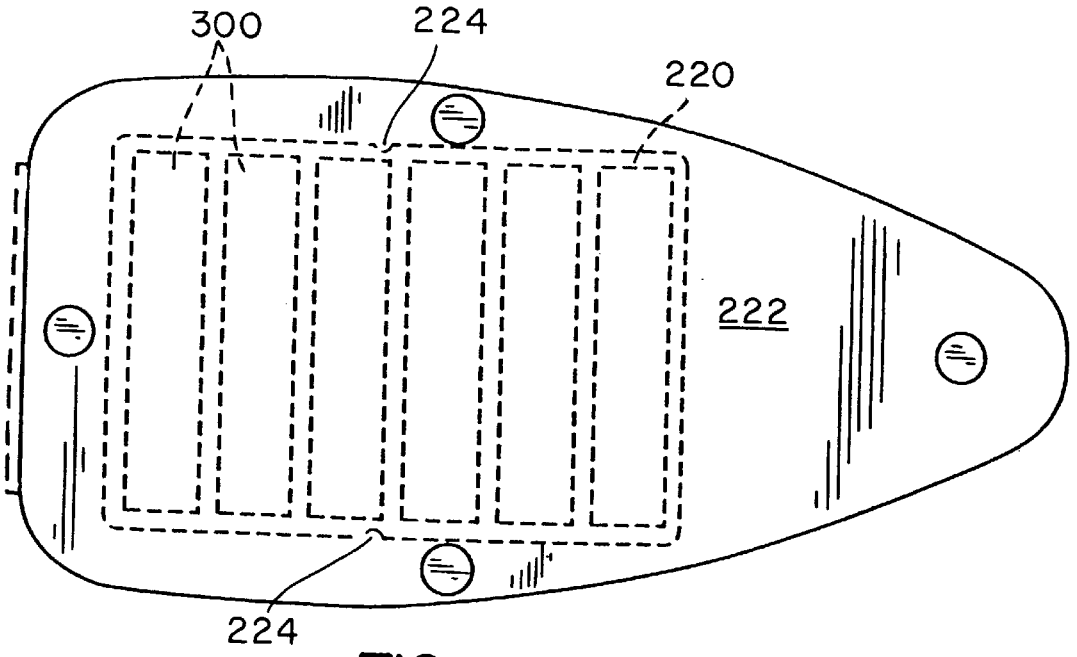
FIG. 13 is a bottom view of the RAZOR CADDY of FIG. 1 with the assembled RAZOR HANDLE and CARTRIDGE together and disassembled from the RAZOR CADDY of FIG. 8, illustrating a bottom view of the RAZOR CADDY having a cartridge dispenser with cartridges positioned therein; the assembled RAZOR HANDLE and CARTRIDGE and cartridge dispenser with cartridges illustrated in broken lines.
Figure 14:
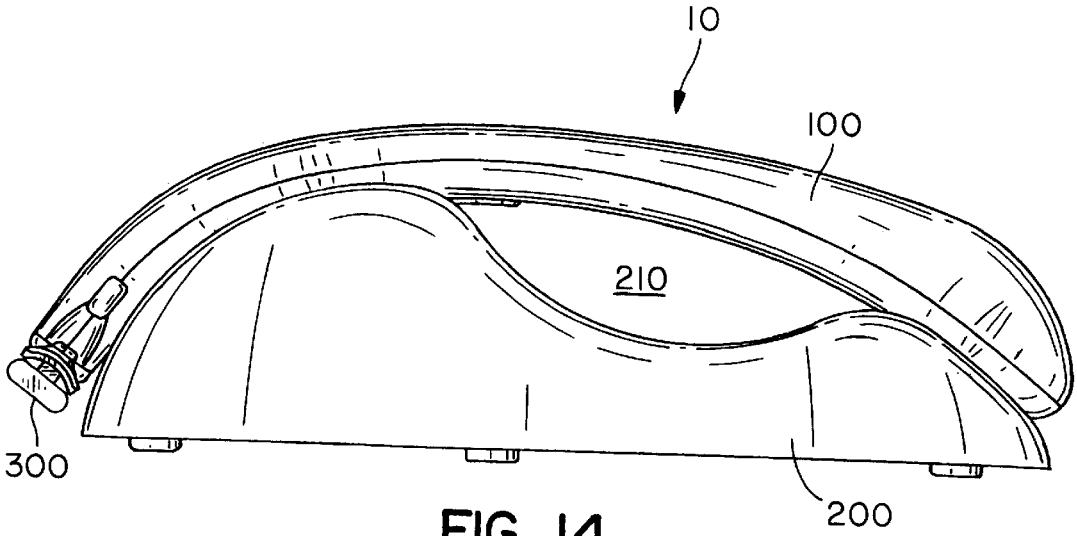
FIG. 14 is a side perspective view of the ASSEMBLED RAZOR HANDLE, CARTRIDGE AND CADDY.
Figure 15:
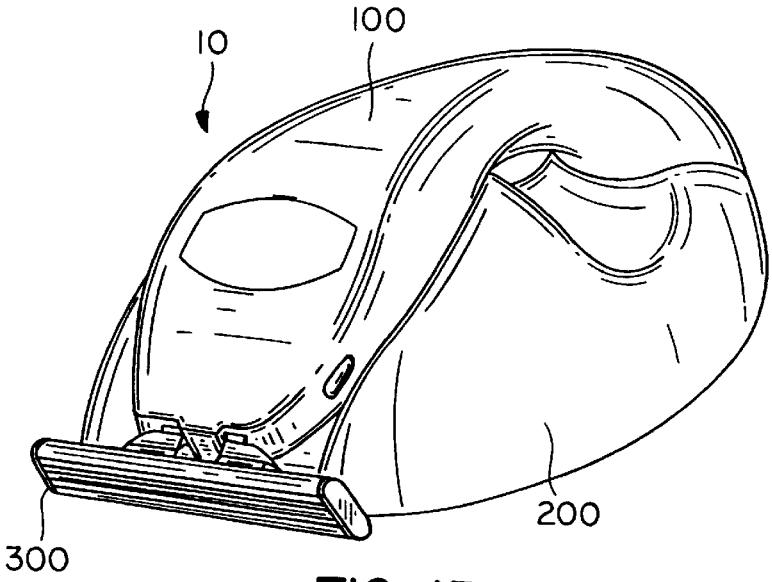
FIG. 15 is a top right front perspective view of the ASSEMBLED RAZOR HANDLE, CARTRIDGE AND CADDY of FIG. 14.
Figure 16:
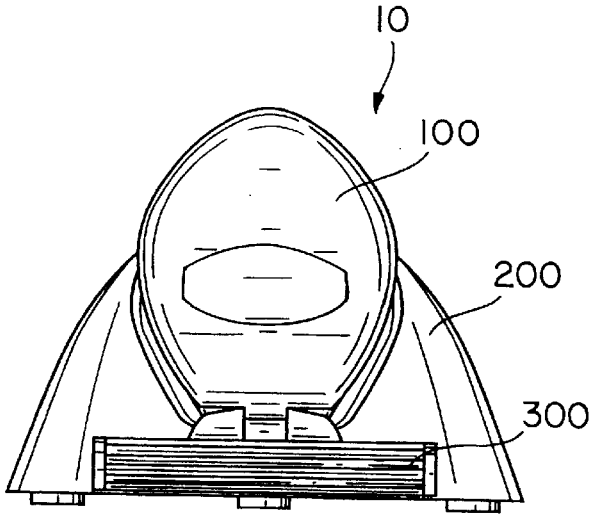
FIG. 16 is front view of the ASSEMBLED RAZOR HANDLE, CARTRIDGE AND CADDY of FIG. 14.
Figure 17:
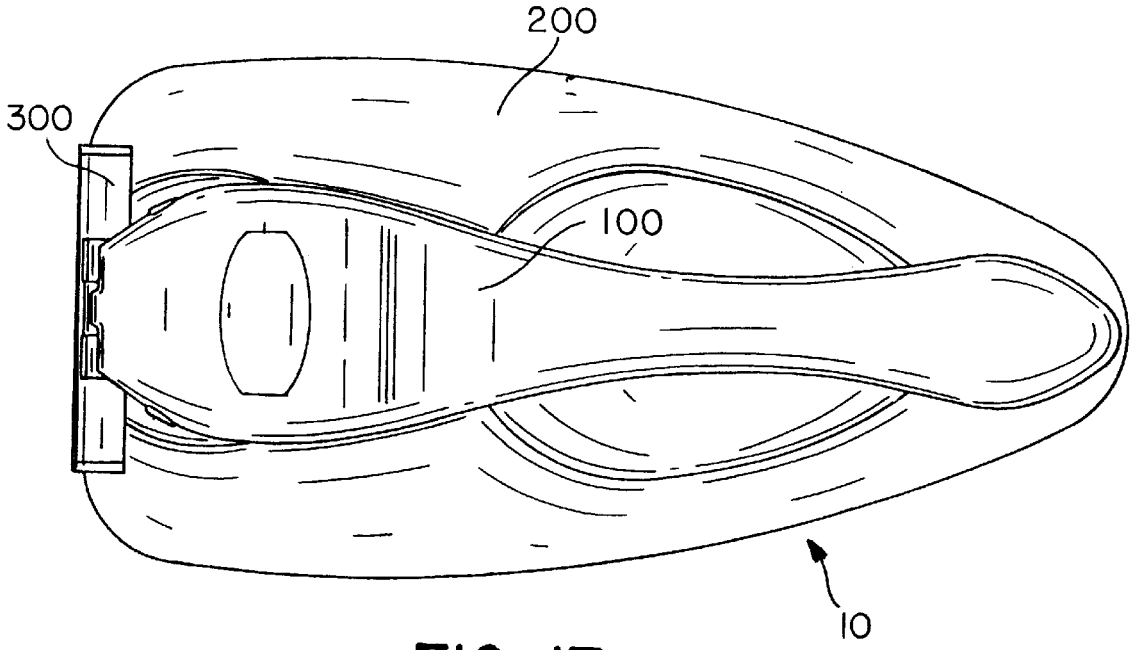
FIG. 17 is a top view of the ASSEMBLED RAZOR HANDLE, CARTRIDGE AND CADDY of FIG. 14 with the RAZOR HANDLE AND CARTRIDGE assembled together and disassembled from the RAZOR CADDY of FIG. 14.
Figure 18:
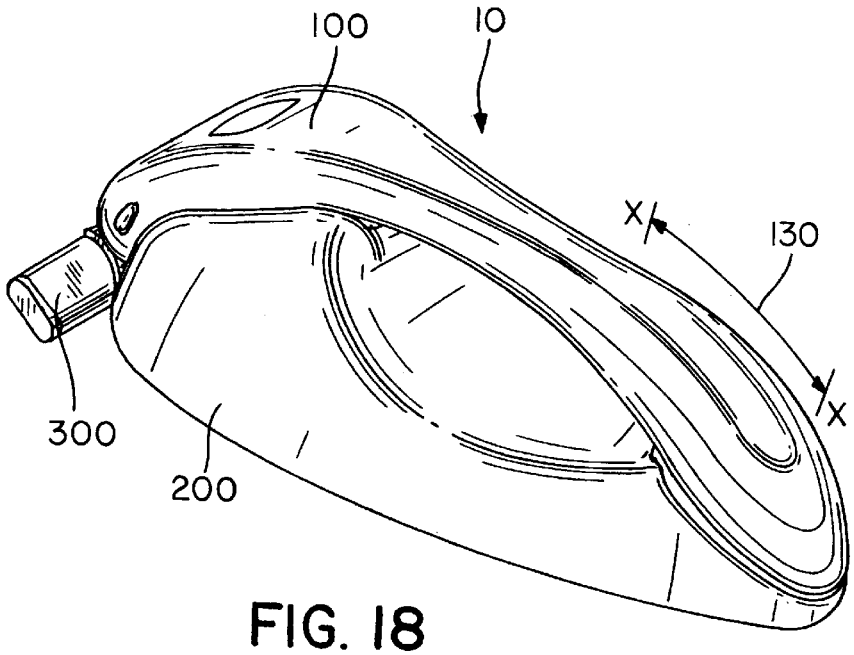
FIG. 18 is a top rear perspective view of the ASSEMBLED RAZOR HANDLE, CARTRIDGE AND CADDY of FIG. 14 with the RAZOR HANDLE AND CARTRIDGE assembled together and disassembled from the RAZOR CADDY of FIG. 14.
Figure 19:
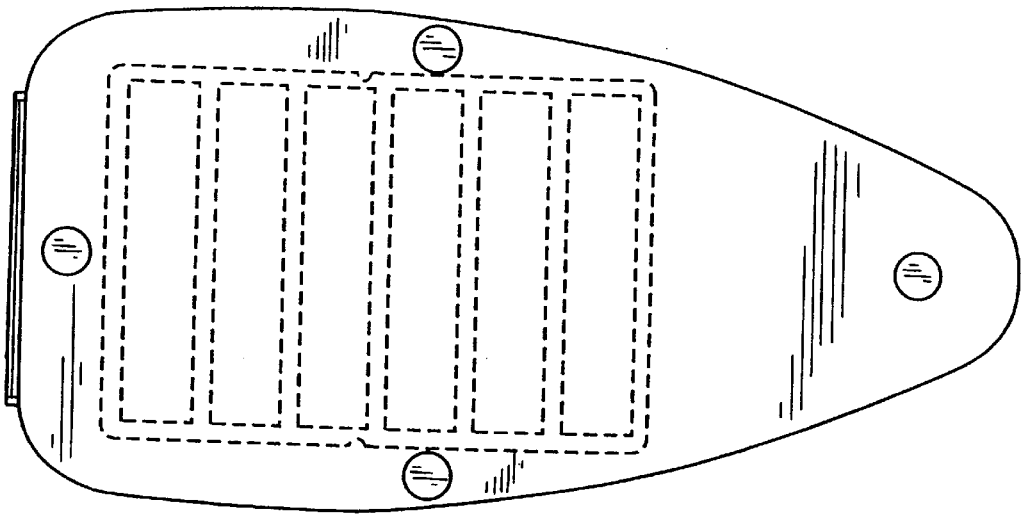
FIG. 19 is a bottom view of the ASSEMBLED RAZOR HANDLE, CARTRIDGE AND CADDY of FIG. 14, showing by dotted lines a cartridge dispenser with cartridges positioned therein.

The normal shaving position (and structure) is defined by an "apex" shaped top surface near the distal end 108, illustrated by points "X—X" in FIG. 2, and the second gripping portion 122. The raised fitting "apex" shaped portion 130 fits into the "life line" crease formed between the thumb and index finger of the user in order to provide secure gripping of the handle. This placement of the "fitting" apex portion 130 into the "life line" crease of the users hand, along with the second gripping area 122 having an elastomeric element positioned near the distal end 108 of the razor handle to receive the thumb and digits, enhances the security of the grip and aids in control. The second gripping area 122 has a hand sensitive engagement surface about the distal end 108 shaped to define correct engagement of one of the finger digits for use of razor in the normal position.

A razor caddy 200 defines at least two spaced apart depressions 202,204 suitable to receive the proximate and distal end 106,108 of the razor handle 100. The razor caddy 200 together with the razor handle 100 defines a substantial "elliptical" opening 210 suitable to receive a users digits upon the bottom surface of the razor handle. A razor cartridge tray 220 having a plurality of positions to receive replacement razor cartridges fits into the bottom surface 222 of the razor caddy 200, and engages one or more latches 224 formed on bottom of the razor caddy 200 to achieve a secure fit. A plurality of razor cartridges 300 are set within the razor tray 220.

A razor cartridge suitable for use with this razor handle is illustrated in U.S. Pat. No. 5,341,571 issued to Frank H. Prochaska entitled MOVABLE BLADE SHAVING CARTRIDGE OR THE LIKE, which patent is hereby incorporated by reference.

The combination of the razor handle and caddy may be formed of a suitable plastic material providing an appearance to suggest a stone finish, such as granite, slate or the like. Also, while an elliptical opening formed between the razor handle 100 and caddy 200, other shapes of the opening may also used, such as arcuate, curved or the like.

Of course, it should be understood that a wide range of changes and modifications can be made to the preferred embodiment described above. It is therefore intended that the foregoing detailed description be understood that it is the following claims, including all equivalents, which are intended to define the scope of this invention.

We claim:

1. A combination of a razor caddy and a razor handle for supporting a razor cartridge, said razor handle having a proximate end and a distal end, said handle comprising an elongated handle defining generally concentric convex top and bottom surfaces having a continuous arcuate index finger profile when gripped with a user's digits on the top surface of the razor handle and a thumb on the bottom surface, said proximate end of the razor handle having widened portions proximate to said proximate end, side portions of the razor handle forming a concave profile between said proximate end and said distal end, said side portions forming widened portions at the distal end of said handle, said index finger profile of said razor handle defining a detail and a normal shaving positions in combination with said top surface and said bottom surface of said handle, a first gripping portion and a second gripping portion each positioned on the bottom surface of the handle, said detail shaving position defined by the first gripping portion having a defined thumb engaging area of elastomeric material proximate to said proximate end, said elastomeric material defining correct placement of the thumb for use of said detail shaving position, said second gripping portion having an elastomeric element positioned near the distal end of said handle, said second portion defining a hand sensitive engagement surface about the distal end to define correct engage of one of the user's digits for use of said normal position, said razor caddy defining at least two spaced apart depressions suitable to receive the proximate end and said distal end of the razor handle, the caddy together with said razor handle defining an opening to receive a user's digits upon the bottom surface of said razor handle.

2. A combination of a razor handle for supporting a razor cartridge and a razor caddy, said handle having a proximate handle portion and a distal handle portion, said handle comprising an elongated handle defining generally concentric convex top and bottom surface s having a continuous arcuate wrist-index finger contour when gripped with at least one finger digit on the top surface of the handle and a thumb on the bottom surface, said bottom surface forming an underside of said razor handle;

said proximate handle portion having a generally flat top and bottom with widened side portions, said side portions forming a concave profile between said proximate handle portion and said distal handle portion, said handle having a detail shaving position defined by said top surface and said bottom surface of said handle having a first gripping portion positioned on the underside of the handle, said detail shaving position defined by the first gripping portion having a thumb engaging area of elastomeric material proximate to said proximate handle portion and in spaced relationship to said top surface, said elastomeric material defining correct placement of the thumb for use of said razor handle in said detail shaving position, said razor caddy defining at least two spaced apart depressions suitable to receive the proximate and distal handle portions of the razor handle, the caddy together with said razor handle defining an opening to receive a user's digits upon the bottom surface of said razor handle.

3. The combination of claim 2, wherein said razor handle defines a normal shaving position, said razor handle having a second gripping portion on the underside of said handle, said second gripping portion having an elastomeric element positioned near the distal handle portion of said handle, said second gripping portion defining a hand sensitive engagement surface about the distal handle portion to define correct engagement of one of the user's digits for use of the handle in said normal shaving position.

4. The combination of claim 3, wherein said second gripping portion having an elastomeric element positioned near the distal handle portion, said second portion defining a hand sensitive engagement surface about the distal handle portion to define correct engagement of one of the user's digits for use of said normal shaving position.

5. A razor handle in combination with a razor caddy, said handle having a proximate end and a distal end for supporting a razor cartridge at said proximate end, said handle comprising a top surface and bottom surface each having a substantially continuous arcuate index finger profile, said proximate end of the razor handle having widened top and bottom portions proximate to said proximate end, side portions integrally formed on the razor handle having a concave profile between said proximate end and said distal end, said side portions forming widened top and bottom surface portions at the distal end of said handle, said index finger profile of said razor handle in combination with said top surface and said bottom surface of said handle defining a detail shaving position, a first gripping portion positioned on the bottom surface of the handle having a thumb engaging area of elastomeric material set proximate to said proximate end, said elastomeric material defining a thumb sensitive correct placement position for use of said detail shaving position, the top surface portion of the distal end defining an apex shaped portion near the distal end, said apex shaped portion fitting into a "life line" crease formed between a thumb and an index finger of a user; and.

said razor handle, in combination with said razor caddy, defining at least two spaced apart depressions suitable to receive said proximate end and said distal end of said razor handle, said razor caddy together with said razor handle defining an opening to receive a user's digits upon the bottom surface of said razor handle.

6. A razor handle in combination with a razor caddy for supporting a razor cartridge at one end, said handle comprising an elongated handle defining generally concentric convex top and bottom surfaces having a continuous arcuate finger contour profile when gripped with at least one finger of a user on the top surface of the handle and a thumb on the bottom surface, said bottom surface forming an underside of said razor handle;

a proximate end having a generally flat top and bottom with widened side portions at said one end, said razor handle having said side portions forming a concave profile between said proximate end and a distal end, said handle having a detail shaving position defined by said top surface and said bottom surface having a first gripping portion positioned on the underside of the handle, said detail shaving position defined by the first gripping portion having a thumb engaging area of elastomeric material proximate to said proximate end, said elastomeric material defining correct placement of the thumb for use of said razor handle in said detail shaving position; and, said handle, in combination with a razor caddy, defining at least two spaced apart depressions suitable to receive said proximate end and said distal end of said razor handle, said caddy together with said razor handle defining an opening to receive a user's digits upon said bottom surface of said razor handle.

7. The combination of claims 1 or 2, wherein said razor handle defines a normal shaving position, said razor handle having a second gripping portion on the bottom surface of said handle, said second gripping portion having an elastomeric element positioned near the distal end, said second gripping portion defining a hand sensitive engagement surface about the distal handle portion to define correct engagement of one of a user's fingers for use of the handle in said normal shaving position.

8. The combination of claim 1, wherein said proximate end defines a generally tongue shape suitable to engage at least two fingers of said user on a top surface of the handle positioned above said first gripping portion.

9. The combination of claim 1, wherein said opening is substantially elliptical in shape of a side profile.

10. The combination of claim 1, wherein a razor cartridge is attached to said razor handle.

* * * * *

UNITED STATES PATENT AND TRADEMARK OFFICE

CERTIFICATE OF CORRECTION

PATENT NO. : 5,903,978

DATED : May 18, 1999

INVENTOR(S) : PROCHASKA et al.

It is certified that error appears in the above-identified patent and that said Letters Patent is hereby corrected as shown below:

Cover page, Item [76] Change "Defiance" to to --Ft. Defiance--

Col. 6, l. 33 Change "1 or 2" to --5 or 6--

Col. 6, l. 45: Change "1" to --5--

Col. 6, l. 47: Change "1" to --5--

Col. 6, l. 42: Change "1" to --5--

Col. 4, l. 52: Change "surface s" to --surfaces--

Signed and Sealed this

Twelfth Day of October, 1999

*Attest:*

Q. TODD DICKINSON

*Attesting Officer*

*Acting Commissioner of Patents and Trademarks*